US009585223B2

(12) United States Patent
Seki et al.

(10) Patent No.: US 9,585,223 B2
(45) Date of Patent: Feb. 28, 2017

(54) ILLUMINATION SYSTEM AND LUMINAIRE

(71) Applicant: Panasonic Intellectual Property Management Co., Ltd., Osaka (JP)

(72) Inventors: Keisuke Seki, Osaka (JP); Akinori Hiramatsu, Nara (JP); Hiroshi Kido, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/988,212

(22) Filed: Jan. 5, 2016

(65) Prior Publication Data

US 2016/0205742 A1 Jul. 14, 2016

(30) Foreign Application Priority Data

Jan. 9, 2015 (JP) ..... 2015-003669

(51) Int. Cl.
*H05B 33/08* (2006.01)

(52) U.S. Cl.
CPC ..... *H05B 33/0887* (2013.01); *H05B 33/0827* (2013.01); *H05B 33/0851* (2013.01)

(58) Field of Classification Search
CPC ..... H05B 33/0815; H05B 33/0818; H05B 33/0884; H05B 33/0809; H05B 33/0848; H05B 33/0896
USPC ..... 315/294, 307, 122, 192, 224
See application file for complete search history.

(56) References Cited

U.S. PATENT DOCUMENTS

2008/0018261 A1* 1/2008 Kastner ..... F21V 23/00 315/192
2009/0134817 A1* 5/2009 Jurngwirth ..... H05B 33/0851 315/307
2010/0052569 A1* 3/2010 Hoogzaad ..... H05B 33/0818 315/294
2011/0068702 A1* 3/2011 van de Ven ..... H05B 33/0854 315/186

(Continued)

FOREIGN PATENT DOCUMENTS

JP 5426802 12/2013
WO WO 2013/118208 A1 8/2013

*Primary Examiner* — Douglas W Owens
*Assistant Examiner* — Syed M Kaiser
(74) *Attorney, Agent, or Firm* — Renner, Otto, Boisselle & Sklar, LLP

(57) ABSTRACT

An illumination system includes: a first light-emitting element column in which one or more first light-emitting elements are serially connected; a second light-emitting element column connected in parallel with the first light-emitting element column, and in which one or more second light-emitting elements are serially connected; a constant current supply that supplies constant current to a light source unit including the first and second light-emitting element columns; a resistor that is connected in series with the first light-emitting element column, and detects magnitude of current flowing through at least the first light-emitting element column; a bypass circuit that passes, to the resistor, at least part of current flowing through the second light-emitting element column, when a predetermined condition is satisfied; and a current adjuster circuit that adjusts the magnitude of the current flowing through the first light-emitting element column, according to the magnitude of the current detected by the resistor.

12 Claims, 10 Drawing Sheets

(56) References Cited

U.S. PATENT DOCUMENTS

| | | | | |
|---|---|---|---|---|
| 2011/0121654 | A1* | 5/2011 | Recker | H02J 9/065 307/66 |
| 2011/0309760 | A1* | 12/2011 | Beland | H02M 1/4258 315/201 |
| 2012/0049742 | A1* | 3/2012 | Lee | H05B 33/0809 315/122 |
| 2012/0081009 | A1* | 4/2012 | Shteynberg | H05B 33/083 315/122 |
| 2012/0212143 | A1* | 8/2012 | Esaki | H05B 33/089 315/192 |
| 2013/0038222 | A1* | 2/2013 | Yeh | H05B 33/0824 315/152 |
| 2014/0159598 | A1* | 6/2014 | Boezen | H05B 33/0848 315/193 |
| 2014/0217919 | A1* | 8/2014 | Kitamura | H05B 33/0818 315/224 |
| 2014/0361711 | A1 | 12/2014 | Takahashi | |

* cited by examiner

ILLUMINATION SYSTEM AND LUMINAIRE

CROSS REFERENCE TO RELATED APPLICATION

This application claims the benefit of priority of Japanese Patent Application Number 2015-003669 filed on Jan. 9, 2015, the entire content of which is hereby incorporated by reference.

BACKGROUND

1. Technical Field

The present disclosure relates to an illumination system and a luminaire using the illumination system.

2. Description of the Related Art

Among conventional luminaires, there are luminaires which include a light source unit having light-emitting elements of plural colors (see, for example, Patent Literature (PTL) 1: Japanese Patent No. 5426802). In the light source unit of the luminaire disclosed in PTL 1, a first light-emitting element column in which first light-emitting elements are connected in series, and a second light-emitting element column in which second light-emitting elements are connected in series, are connected in parallel. A first light-emitting element and a second light-emitting element have different color temperatures. In such a luminaire, various color toning can be performed by, for example, changing the light-emitting ratio between plural light-emitting element columns.

SUMMARY

However, the luminaire disclosed in PTL 1 has the problem that the color toning range is not sufficiently broad. As such, there is a demand for further broadening of the color toning range in luminaires.

In view of this, an object of the present disclosure is to provide an illumination system and a luminaire which allow broadening of the color toning range.

In order to achieve the above object, an illumination system according to an aspect of the disclosure includes: a first light-emitting element column including one of a single first light-emitting element or a plurality of first light-emitting elements connected in series; a second light-emitting element column connected in parallel with the first light-emitting element column, and including one of a single second light-emitting element or a plurality of second light-emitting elements connected in series; a constant current supply that supplies a constant current to a light source unit that includes the first light-emitting element column and the second light-emitting element column; a first detector circuit that is connected in series with the first light-emitting element column, and detects a magnitude of current flowing through at least the first light-emitting element column; a current adjuster circuit that adjusts the magnitude of the current flowing through the first light-emitting element column, according to the magnitude of the current detected by the first detector circuit; and a bypass circuit that passes, to one of the first detector circuit or the current adjuster circuit, at least part of current flowing through the second light-emitting element column, when a predetermined condition is satisfied.

Illumination systems and luminaires according to the present disclosure allow broadening of the color toning range.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF EMBODIMENT

Figure 1:
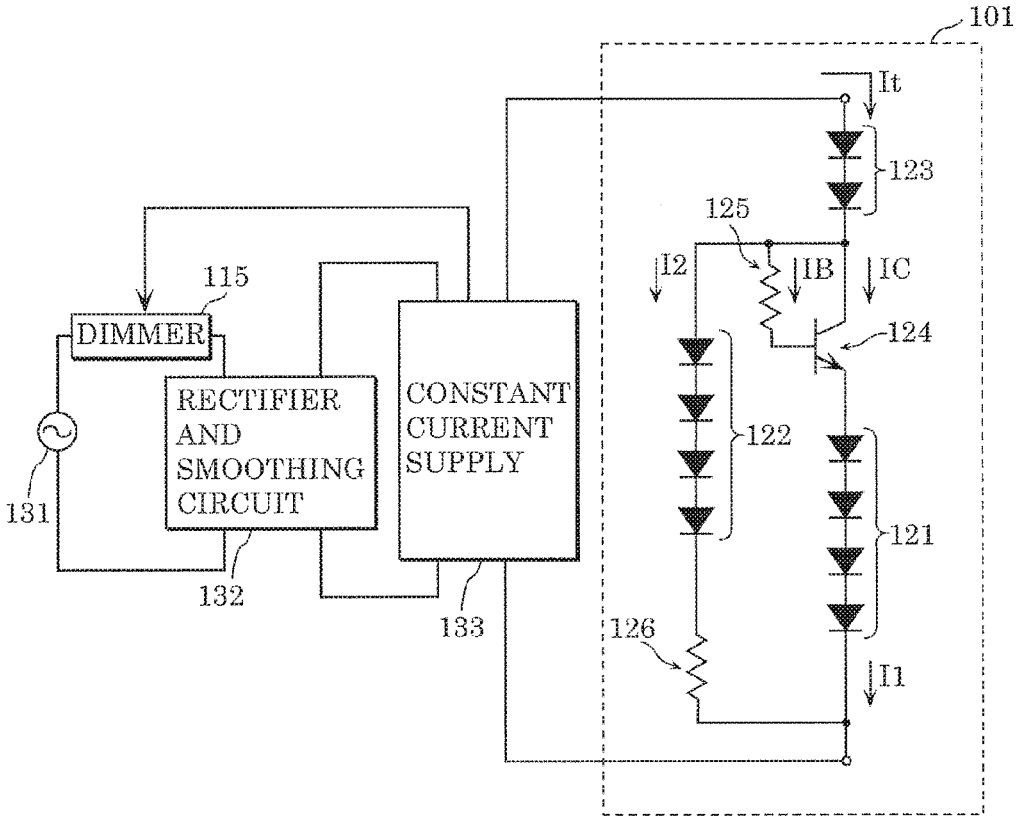
FIG. 1 PRIOR ART
FIG. 1 is a diagram illustrating a configuration of a luminaire in a comparative example.

Details of the Problem and Underlying Knowledge Forming Basis of the Present Disclosure FIG. 1 is a diagram illustrating, as a comparative example, the configuration of a luminaire disclosed in PTL 1.

The luminaire disclosed in PTL1 includes alternating current (AC) power supply 131, dimmer 115, rectifier and smoothing circuit 132, constant current supply 133, and lighting circuit 101.

AC power supply 131 supplies AC voltage to the luminaire. Dimmer 115 is a circuit that adjusts the magnitude (amount) of the current that is supplied to lighting circuit 101, by changing the input voltage to rectifier and smoothing circuit 132 according to a dimming operation from the outside. By changing the input voltage to rectifier and smoothing circuit 132, the magnitude of the current to be outputted from constant current supply 133 can, as a result, be adjusted.

Lighting circuit 101 includes cool color light-emitting diode (LED) column 121, warm color LED column 122, LED column 123, bipolar transistor 124, and resistors 125 and 126.

Lighting circuit 101 includes parallel circuits in which a first serial circuit in which cool color LED column 121 and bipolar transistor 124 are connected in series, and a second serial circuit in which warm color LED column 122 and resistor 126 are connected in series, are connected in parallel. LED column 123 is connected in series to the parallel circuits.

LED column 123 consists of two LEDs that are connected in series. In the subsequent description, the cathode terminal of the leading LED in the direction in which current flows is referred to as the cathode terminal of LED column 123, and the anode terminal of the trailing LED is referred to as the anode terminal of LED column 123. LED column 123 has the anode terminal connected to one end of constant current supply 133; and the cathode terminal connected to a collector terminal of bipolar transistor 124, one end of resistor 125, and the anode terminal of cool color LED column 122.

Resistor 125 has one end connected to the cathode terminal of LED column 123, the collector terminal of bipolar transistor 124, and the anode terminal of warm color LED column 122; and the other end connected to a base terminal of bipolar transistor 124.

Bipolar transistor 124 has the base terminal connected to the other end of resistor 125; an emitter terminal connected to the anode terminal of cool color LED column 121; and the collector terminal connected to the output node (node to which the cathode electrode is connected) of LED column 123.

Cool color LED column 121 consists of four cool color LEDs that are connected in series. In the subsequent description, the cathode terminal of the leading cool color LED is referred to as the cathode terminal of cool color LED column 121, and the anode terminal of the last cool color LED is referred to as the anode terminal of cool color LED column 121. Cool color LED column 121 has the anode terminal connected to the emitter terminal of bipolar transistor 124; and the cathode terminal connected to the other end of constant current supply 133 and one end of resistor 126.

Warm color LED column 122 consists of four warm color LEDs that are connected in series. In the subsequent description, the cathode terminal of the leading warm color LED is referred to as the cathode terminal of warm color LED column 122, and the anode terminal of the last warm color LED is referred to as the anode terminal of warm color LED column 122. Warm color LED column 122 has the anode terminal connected to the cathode terminal of LED column 123, the collector terminal of bipolar transistor 124, and the one end of resistor 125; and the cathode terminal connected to the other end of resistor 126.

Resistor 126 has one end connected to the other end of constant current supply 133 and the cathode terminal of cool color LED column 121; and the other end connected to the cathode terminal of warm color LED column 122.

In this luminaire, bipolar transistor 124 functions as a variable resistance element having a resistance that changes according to the magnitude of the current flowing through warm color LED column 122. A change in the resistance of bipolar transistor 124 causes the magnitude of the current flowing through cool color LED column 121 to change.

In other words, in the luminaire in PTL 1, the total of the currents flowing through cool color LED column 121 and warm color LED column 122 is the same as the magnitude of the output current of constant current supply 133, and dimming control is performed by changing the ratio of currents flowing through cool color LED column 121 and warm color LED column 122, according to the magnitude of the current flowing through warm color LED column 122.

Figure 2:
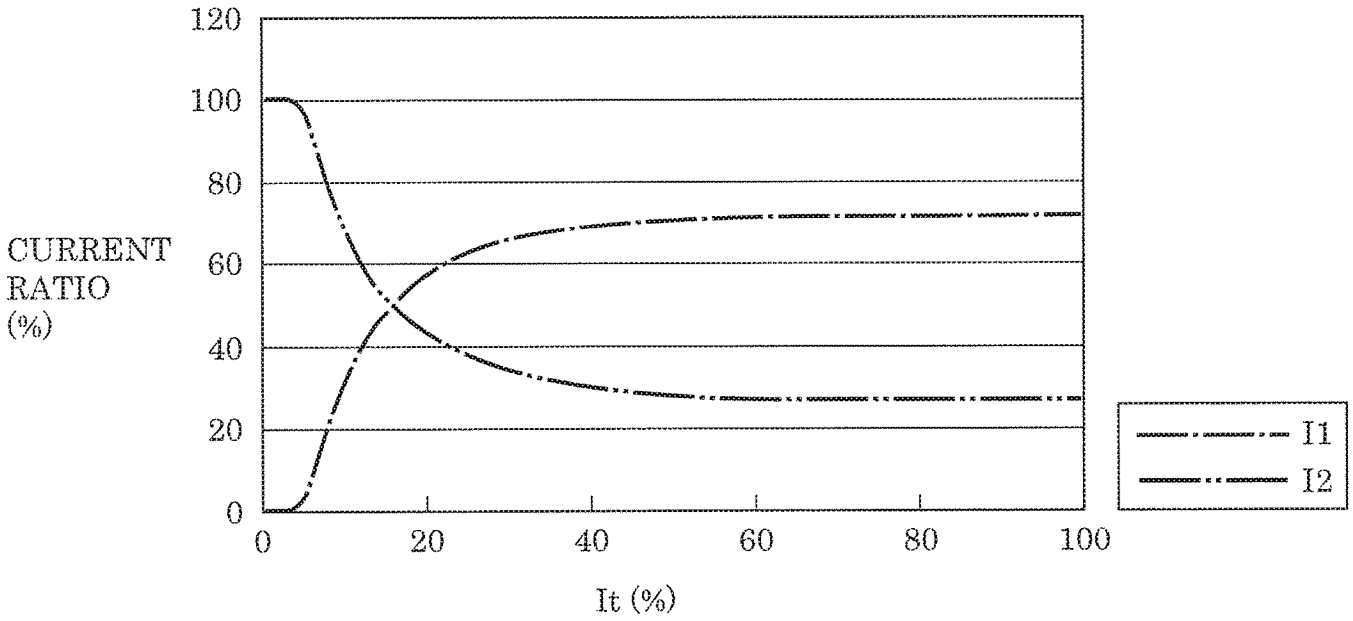
FIG. 2 PRIOR ART
FIG. 2 is a graph illustrating an example of the magnitude of currents flowing through two light-emitting element columns of the luminaire in the comparative example.

FIG. 2 is a graph illustrating an example of the magnitude of currents flowing through two light-emitting element columns in the luminaire (comparative example) disclosed in PTL 1. In FIG. 2, the vertical axis indicates the current ratio of the two currents, and the horizontal axis indicates the magnitude of current outputted from constant current supply 133. The horizontal axis indicates the percentages (%) when the maximum value is 100%.

As illustrated in FIG. 2, in the luminaire disclosed in PTL 1, as the magnitude of the constant current It from constant current supply 133 increases, the ratio of current I1 flowing through cool color LED column 121 increases and the ratio of current I2 flowing through warm color LED column 122 decreases.

Here, as can be seen from FIG. 2, in the luminaire disclosed in PTL 1, except at the start of output (0%) of constant current supply 133, both cool color LED column 121 and warm color LED column 122 are always turned ON. In the luminaire disclosed in PTL 1, even when it is desired to make the color of warm color LED column 122 clearer immediately after the luminaire is turned ON, cool color LED column 121 is also turned ON, which results in color toning in which the cool color is slightly mixed-in with the warm color.

As such, there is a demand for further broadening of the color toning range.

Hereinafter, an illumination system and a luminaire according to an embodiment of the present disclosure are described in detail with reference to the drawings. It should be noted that the subsequently-described embodiment shows a specific example of the present disclosure. Therefore, numerical values, shapes, materials, structural components, the arrangement and connection of the structural components, etc. shown in the following embodiment are mere examples, and are not intended to limit the scope of the present disclosure. Furthermore, among the structural components in the following embodiment, components not recited in any one of the independent claims which indicate the broadest concepts of the present disclosure are described as arbitrary structural components.

Furthermore, the respective figures are schematic diagrams and are not necessarily precise illustrations. In addition, in the respective diagrams, identical structural components are given the same reference signs.

Embodiment

An illumination system and a luminaire including the illumination system in an embodiment will be described using FIG. 3 to FIG. 6, and FIG. 7A and FIG. 7B.

Figure 3:
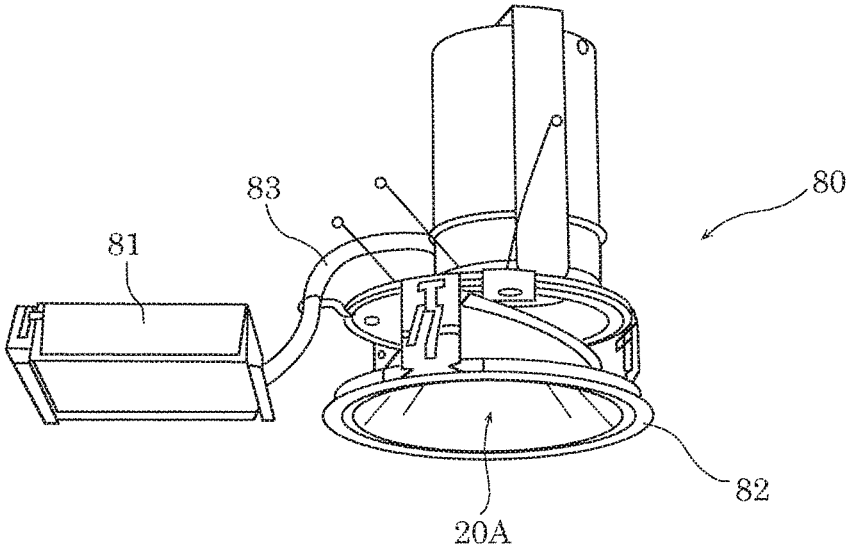
FIG. 3 is a perspective view of an example of the external appearance of a luminaire in an embodiment.

FIG. 3 is a perspective view of an example of the external appearance of the luminaire in this embodiment. Luminaire 80 illustrated in FIG. 3 is a downlight, and includes circuit box 81, lamp body 82, and wire 83. Circuit box 81 houses circuits (constant current supply, three-terminal regulator, current adjuster circuit, and current detector circuit (not illustrated)) included in luminaire 80. Lamp body 82 houses light source unit 20A. Wire 83 is a wire that connects the circuits and the light source unit included in luminaire 80.

1. Luminaire Configuration

Figure 4:
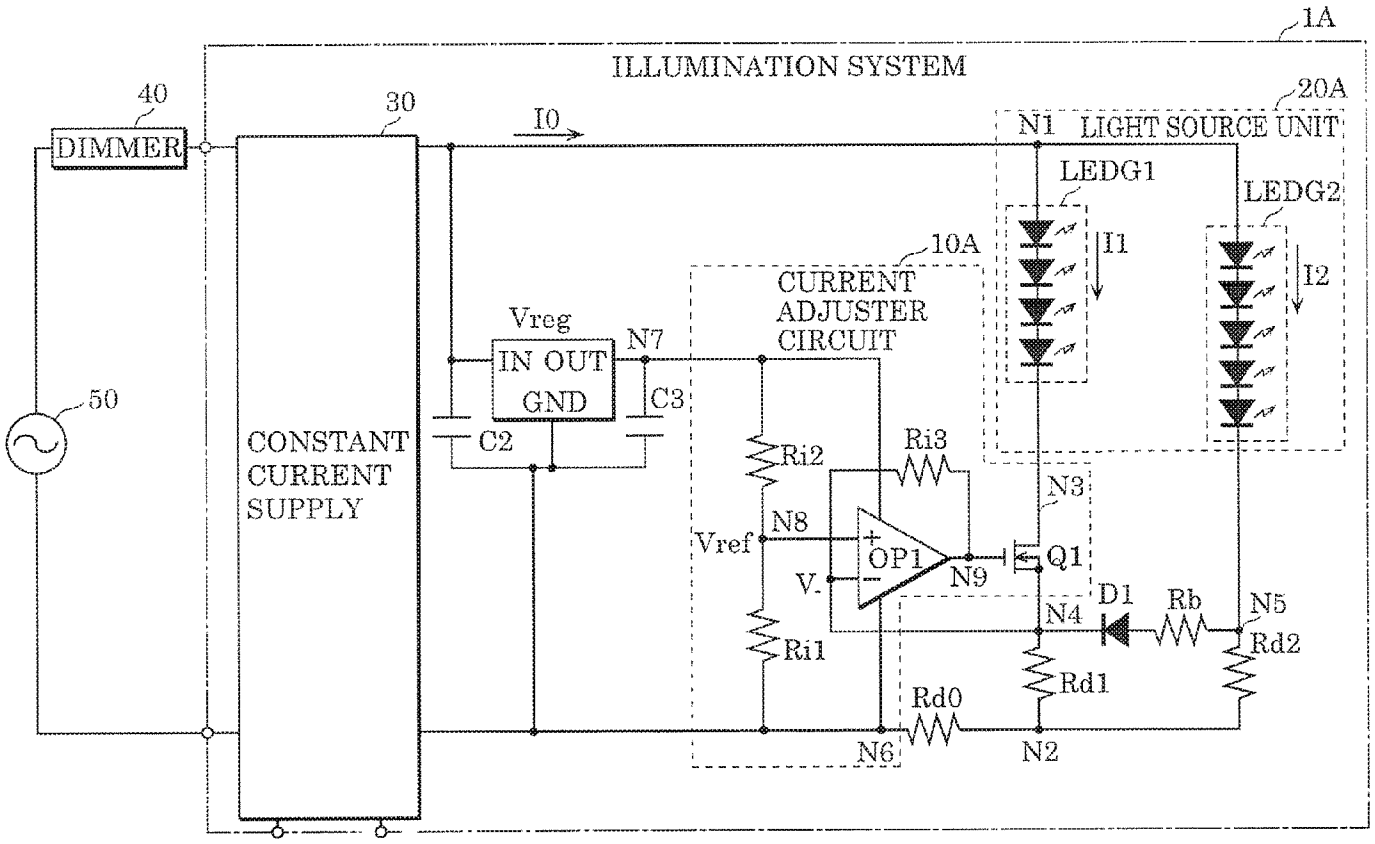
FIG. 4 is a circuit diagram illustrating an example of the circuit configuration of an illumination system in the embodiment.

FIG. 4 is a circuit diagram illustrating an example of the circuit configuration of luminaire 80 in this embodiment. Luminaire 80 is an appliance having a dimming function, and, as illustrated in FIG. 4, includes dimmer 40 and illumination system 1A, and power is supplied from alternating current (AC) power supply 50.

AC power supply 50 is, for example, an external commercial power supply.

Here, dimmer 40 is a phase-control dimmer, and adjusts the range of the phase (ON-phase) of the AC voltage to be inputted to constant current supply 30, according to a control signal from an illumination controller (not illustrated). The greater the range of the phase is, the greater the magnitude (amount) of constant current I0 outputted from constant current supply 30 becomes. The illumination controller enables operation to change the brightness of the luminaire in plural stages, and, when operated by a user, outputs a control signal indicating the brightness after the change (i.e., the new brightness) to dimmer 40. Dimmer 40 adjusts the aforementioned range of the phase according to the control signal. It should be noted that dimmer 40 may be a dimmer using another control method such as the pulse width modulation (PWM) control method, etc.

[1-1. Illumination System Configuration]

Illumination system 1A includes plural light sources (light-emitting element columns) of different color temperatures, and is a system for performing color toning of light to be outputted, according to a change in one parameter such as the magnitude of the constant current outputted from constant current supply 30. Illumination system 1A is configured to distribute the constant current to the light-emitting element columns, and performs color toning by adjusting the brightness of each light-emitting element column by changing the ratio of current that is passed to the respective light-emitting element columns.

As illustrated in FIG. 4, illumination system 1A includes constant current supply 30, light source unit 20A, three-terminal regulator Vreg, a first detector circuit (resistor Rd1), a second detector circuit, a constant current detector circuit (resistor Rd0), current adjuster circuit 10A, and a bypass circuit.

[Constant Current Supply]

Constant current supply 30 supplies constant current I0 to light source unit 20A, that is, first light-emitting element column LEDG1 and second light-emitting element column LEDG2 which are connected in parallel. As described above, dimmer 40 adjusts the range of the phase (ON-phase) of the AC voltage to be inputted to constant current supply 30, out of AC power supply 50. Although not illustrated in the figure, constant current supply 30 includes a voltage-raising or voltage-dropping circuit, a rectifier circuit, a smoothing circuit, etc., converts the inputted AC voltage into direct current (DC) voltage, and supplies, to light source unit 20A, constant current IO (DC current) of a magnitude corresponding to the DC current resulting from the conversion.

Details of such a constant current supply 30 are well known by those of ordinary skill in the art, and are omitted herein for sake of brevity.

[Light Source Unit]

Here, light source unit 20A includes first light-emitting element column LEDG1 and second light-emitting element column LEDG2 which are connected in parallel.

First light-emitting element column LEDG1 includes four LEDs of the same type which are connected in series. Here, LEDs of "the same type" refers to LEDs having forward voltages of the same magnitude. The four LEDs are examples of first light-emitting elements. The four LEDs included in first light-emitting element column LEDG1 are what are called light bulb color LEDs having a color temperature of 2700 K. It should be noted that, although it is sufficient that the four LEDs included in first light-emitting element column LEDG1 have the same color temperature, using what are referred to here as "the same type" of LEDs allows for reduction in cost.

In the subsequent description, the cathode terminal of the leading LED of first light-emitting element column LEDG1 in the direction in which current flows is referred to as the cathode terminal of first light-emitting element column LEDG1, and the anode terminal of the fourth LED in the direction in which current flows is referred to as the anode terminal of first light-emitting element column LEDG1. In first light-emitting element column LEDG1, the anode terminal and the cathode terminal are connected to node N1 and node N3, respectively. Furthermore, the current flowing through first light-emitting element column LEDG1 is referred to as current I1.

Second light-emitting element column LEDG2 includes five LEDs of the same type which are connected in series. Here, LEDs of "the same type" refers to LEDs having forward voltages of the same magnitude. The five LEDs are examples of second light-emitting elements. The five LEDs included in second light-emitting element column LEDG2 are what are called daylight white color LEDs having a color temperature of 5000 K. It should be noted that the forward voltages of all the LEDs included in second light-emitting element column LEDG2 are the same as the forward voltages of the LEDs included in first light-emitting element column LEDG1. It should be noted that, although it is sufficient that the five LEDs included in second light-emitting element column LEDG2 have the same color temperature, using what are referred to here as "the same type" of LEDs allows for reduction in cost.

In the subsequent description, the cathode terminal of the leading LED of second light-emitting element column LEDG2 in the direction in which current flows is referred to as the cathode terminal of second light-emitting element column LEDG2, and the anode terminal of the fifth LED in the direction in which current flows is referred to as the anode terminal of second light-emitting element column LEDG2. In second light-emitting element column LEDG2, the anode terminal and the cathode terminal are connected to node N1 and node N5, respectively. Furthermore, the current flowing through second light-emitting element column LEDG2 is referred to as current I2.

In this embodiment, the number of LEDs of first light-emitting element column LEDG1 is less than the number of LEDs of second light-emitting element column LEDG2. In other words, the sum of the forward voltages of the one or more LEDs belonging to second light-emitting element column LEDG2 is greater than the sum of the forward voltages of the one or more LEDs belonging to first light-emitting element column LEDG1. As such, when the voltage difference between node N1 and node N2 is greater than the sum of the forward voltages of first light-emitting element column LEDG1 and less than the sum of the forward voltages of second light-emitting element column LEDG2, current flows through first light-emitting element column LEDG1 but current does not flow through second light-emitting element column LEDG2. In other words, in this embodiment, dimming to turn ON first light-emitting element column LEDG1 and turn OFF second light-emitting element column LEDG2 becomes possible.

Figure 5:
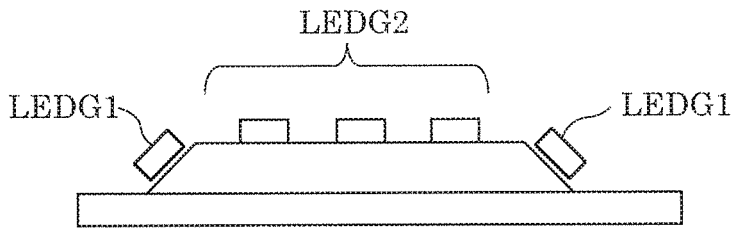
FIG. 5 is a diagram illustrating an example of the configuration of light sources in the embodiment.

FIG. 5 is a cross-sectional view of an example of the arrangement of first light-emitting element column LEDG1 and second light-emitting element column LEDG2 in this embodiment. First light-emitting element column LEDG1 and second light-emitting element column LEDG2 are arranged on a base which is shaped like a circular truncated cone. The four LEDs included in first light-emitting element column LEDG1 are dispersed on the sloped face of the base (two of the LEDs are illustrated in FIG. 5). The five LEDs included in second light-emitting element column LEDG2 are dispersed on the top face of the base (three of the LEDs are illustrated in FIG. 5). In this manner, the light distribution characteristics of first light-emitting element column LEDG1 and second light-emitting element column LEDG2 can be made different by adjusting the angles and positions of first light-emitting element column LEDG1 and second light-emitting element column LEDG2.

[Three-Terminal Regulator]

Three-terminal regulator Vreg is a conventional circuit that generates a constant output voltage, and has input terminal IN connected to node N1 and output terminal OUT connected to node N7. Capacitor C2 is connected between input terminal IN and grounding terminal GND. Capacitor C3 is connected between output terminal OUT and grounding terminal GND.

[First Detector Circuit]

The first detector circuit is a circuit that detects the magnitude of current I1 flowing through first light-emitting element column LEDG1. The first detector circuit is connected in series to first light-emitting element column LEDG1. More specifically, in this embodiment, the first detector circuit is resistor Rd1 having one end connected to node N4 and the other end connected to node N2.

Node N4 is a node to which the source terminal of transistor Q1 included in current adjuster circuit 10A, the minus-side input terminal of operational amplifier (op amp) OP1 included in current adjuster circuit 10A, and the bypass circuit (described below) are connected.

[Second Detector Circuit]

The second detector circuit is a circuit that detects the magnitude of current I2 flowing through second light-emitting element column LEDG2. The second detector circuit is connected in series to second light-emitting element column LEDG2. More specifically, in this embodiment, the second detector circuit is resistor Rd2 having one end connected to node N5 and the other end connected to node N2. Node N5 is a node to which the bypass circuit is connected.

[Constant Current Detector Circuit]

The constant current detector circuit is a circuit that detects the magnitude of constant current I0. In this embodiment, the constant current detector circuit is resistor Rd0 having one end connected to node N2 and the other end connected to the low voltage-side terminal (node N6) of constant current supply 30.

Where the resistance of resistor Rd0 is denoted as R0, the voltage of node N2 is a voltage obtained by adding the voltage drop in resistor Rd0 to the voltage of the low voltage-side terminal (node N6) of constant current supply 30.

Therefore, a voltage obtained by adding, to the voltage of the low voltage-side terminal (node N6) of constant current supply 30, a voltage equivalent to the voltage drop in resistor Rd0 and a voltage equivalent to the voltage drop in resistor Rd1, which is the first detector circuit, is inputted to the minus-side input terminal of op amp OP1.

Where the resistance of resistor Rd0 is denoted as R0, the voltage equivalent to the voltage drop in resistor Rd0 can be represented by R0×I0. Where the resistance of resistor Rd1 is denoted as R1, and the current supplied from the bypass circuit is denoted as Ib, the voltage equivalent to the voltage drop in resistor Rd1 is represented by R1×(I1+Ib). Where the voltage of low voltage-side terminal (node N6) of constant current supply 30 is the grounding voltage, a voltage R0×I0+R1×(I1+Ib) is inputted to the minus-side input terminal of op amp OP1.

[Bypass Circuit]

The bypass circuit is a circuit that passes, to the first detector circuit, at least part of the current flowing through second light-emitting element column LEDG2, when a predetermined condition is satisfied. In this embodiment, the bypass circuit passes, to the first detector circuit, at least part of the current flowing through second light-emitting element column LEDG2, when, as the predetermined condition, the voltage drop in second light-emitting element column LEDG2 is less than the voltage drop in first light-emitting element column LEDG1. Specifically, the bypass circuit is a circuit in which diode D1 and resistor Rb are connected in series. Diode D1 has the cathode terminal connected to node N4, and the anode terminal connected to one end of resistor Rb. Resistor Rb has the one end connected to the anode terminal of diode D1, and the other end connected to node N5.

According to the above-described configuration, when the forward voltage of diode D1 is not negligible, the predetermined condition is that: the voltage of node N5>the voltage of node N4+the forward voltage of diode D1. Stated differently, the predetermined condition is that the voltage drop in the second light-emitting element column is less than a value obtained by subtracting the forward voltage of diode D1 from the voltage drop in the first light-emitting element column. The bypass circuit passes, to the first detector circuit, at least part of the current flowing through second light-emitting element column LEDG2, when the voltage of node N5 becomes greater than the sum of the voltage of node N4 and the forward voltage of diode D1 (i.e., the predetermined condition is satisfied).

[Current Adjuster Circuit]

Current adjuster circuit 10A is a circuit that adjusts the magnitude of the current flowing through first light-emitting element column LEDG1, according to the magnitude of the current detected by the first detector circuit. More specifically, current adjuster circuit 10A compares the magnitude of the current detected by the first detector circuit with a reference value, and changes the magnitude of the current flowing through first light-emitting element column LEDG1 according to the result of the comparison. It should be noted that current adjuster circuit 10A in this embodiment adjusts the magnitude of the current flowing through first light-emitting element column LEDG1, according to the magnitude of the constant current detected by the constant current detector circuit, in addition to the magnitude of the current flowing through first light-emitting element column LEDG1.

As illustrated in FIG. 4, current adjuster circuit 10A includes a voltage divider circuit, transistor Q1, and a comparator amplifier circuit.

The voltage divider circuit is a circuit that generates reference voltage Vref from a constant voltage outputted from three-terminal regulator Vreg, and outputs a voltage obtained from dividing the constant voltage to the plus-side input terminal of op amp OP1. The voltage divider circuit is configured of the series circuit of resistors Ri1 and Ri2, with node N8, which is the connecting node of resistors Ri1 and Ri2, serving as an output node. Resistor Ri1 has one end connected to node N6 and the other end connected to node N8. Resistor Ri2 has one end connected to node N7 (node to which output terminal OUT of three-terminal regulator Vreg is connected) and the other end connected to node N8.

Reference voltage Vref is a voltage calculated by: (output voltage of three-terminal regulator Vreg)×Ri1/(Ri1+Ri2).

Transistor Q1 is a transistor that adjusts the current flowing through first light-emitting element column LEDG1. Transistor Q1 is a metal-oxide-semiconductor field-effect transistor (MOSFET), and has a gate terminal connected to the output terminal (node N9) of the comparator amplifier circuit, a drain terminal connected to the cathode terminal (node N3) of first light-emitting element column LEDG1, and a source terminal connected to the minus-side input terminal of op amp OP1 and the one end (node N4) of resistor Rd1. In other words, first light-emitting element column LEDG1, the drain terminal and source terminal of transistor Q1, and resistor Rd1, which is the first detector circuit, are connected in series between node N1 and node N2.

The comparator amplifier circuit compares the voltage drops in resistor Rd1 and resistor Rd0 with the reference value, and applies a voltage that is in accordance with the result of the comparison to the control terminal (i.e., gate terminal) of transistor Q1. Here, the comparator amplifier circuit is op amp OP1 having the plus-side input terminal connected to the output node (node N8) of the voltage divider circuit, the minus-side input terminal connected to node N4 which is the output node of the first detector circuit, and an output terminal connected to the gate terminal of transistor Q1. Resistor Ri3 is connected between the minus-side input terminal and the output terminal of op amp OP1.

As described above, a voltage obtained by adding the voltage (R0×I0) equivalent to the voltage drop in resistor Rd0 and the voltage (R1×(I1+Ib)) equivalent to the voltage drop in resistor Rd1 to the grounding voltage of constant current supply 30 is inputted to the minus-side input terminal of op amp OP1. Op amp OP1 compares the voltage drop (R1×(I1+Ib)) in resistor Rd1 and the voltage drop (R0×I0) in resistor Rd0 with reference voltage Vref (i.e., the reference value). When the voltage inputted to the minus-side input terminal of op amp OP1 is less than reference voltage Vref, op amp OP1 outputs a high-level (H-level) signal of a magnitude that is in accordance with the difference between the voltage inputted to the minus-side input terminal and reference voltage Vref. Op amp OP1 outputs a low-level (L-level) signal when the voltage inputted to the minus-side input terminal is greater than reference voltage Vref.

2. Operation

Figure 6:
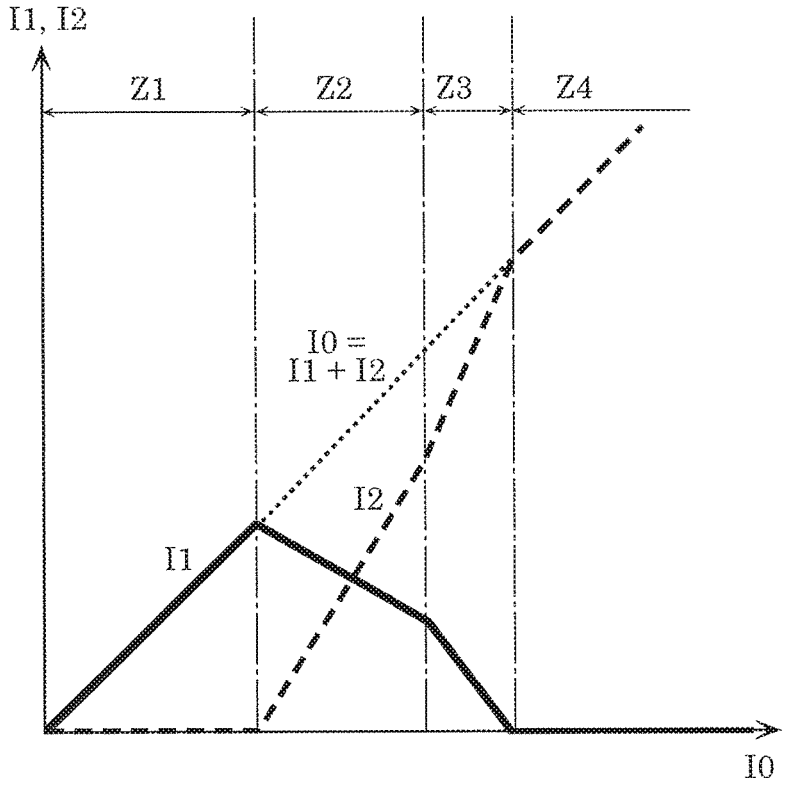
FIG. 6 is a graph illustrating an example of the relationship (dimming pattern) between respective currents flowing through a first light-emitting element column, and a second light-emitting element column and a constant current, in the embodiment.

The operation of current adjuster circuit 10A will be described using FIG. 6. FIG. 6 is a graph illustrating an example of the relationship between current I1 flowing through first light-emitting element column LEDG1 and current I2 flowing through second light-emitting element column LEDG2, and the constant current, in this embodiment. In FIG. 6, the horizontal axis indicates the magnitude of constant current I0, and the vertical axis indicates the magnitude of currents I1 and I2.

In FIG. 6, the graph includes range Z1 in which current I2 is 0, ranges Z2 and Z3 in which both current I1 and current I2 are greater than 0, and range Z4 in which current I1 is 0.

(1) Range Z1

Range Z1 is a range in which the magnitude of constant current I0 is less than or equal to a first threshold value. In range Z1, first light-emitting element column LEDG1 is turned ON and second light-emitting element column LEDG2 is turned OFF.

At this time, since the relationship Vref≥(R0+R1)×I0 is satisfied, the first threshold value is represented by Vref/(R0+R1). In range Z1, current adjuster circuit 10A changes the magnitude of current I1 flowing through first light-emitting element column LEDG1 so that current I2 flowing through second light-emitting element column LEDG2 becomes 0.

In range Z1, voltage V− of the minus-side input terminal of op amp OP1 is sufficiently less than Vref, and thus the output voltage of op amp OP1 is fixed at what is called the H-level. With this, transistor Q1 operates in a linear region (i.e., what is called the drain-source resistance becomes extremely small).

Stated differently, range Z1 is a range in which the sum of the forward voltages of second light-emitting element column LEDG2 is less than the voltage obtained by adding the voltage drop in resistor Rd1 to the sum of the forward voltages of the first light-emitting element column LEDG1, and current I2 of second light-emitting element column LEDG2 is 0.

(2) Range Z2

Range Z2 is a range in which current is not supplied from the bypass circuit (i.e., the range in which the predetermined condition is not satisfied), out of the range in which the magnitude of constant current I0 is greater than the first threshold value and less than a second threshold value (i.e., range Z2+range Z3). It should be noted that the second threshold value is greater than the first threshold value. In range Z2, both first light-emitting element column LEDG1 and second light-emitting element column LEDG2 are turned ON.

In range Z2, the following relationships are satisfied: (R0+R1)×I0>Vref>R0×I0; and R1×I1>R2×I2+Vd. Here, Vd is the forward voltage of diode D1. In range Z2, current adjuster circuit 10A adjusts the magnitude of the current flowing through first light-emitting element column LEDG1 so that current I1 becomes smaller and current I2 becomes bigger as constant current I0 becomes bigger.

In range Z2, the difference between voltage V− of the minus-side input terminal and voltage Vref of the plus-side input terminal of op amp OP1 becomes relatively small, and thus the output voltage of op amp OP1 becomes small. As such, transistor Q1 operates in a saturation region (i.e., operates as what is called a variable resistance element).

Specifically, when reference voltage Vref is greater than voltage V−, the output voltage of op amp OP1 becomes larger as the difference between reference voltage Vref and voltage V− is bigger. Here, voltage V− is represented by R1×I1+R0×I0.

The smaller current I1 is, the smaller the voltage drops in resistors Rd0 and Rd1 become, and the bigger the difference between reference voltage Vref and voltage V− becomes. Consequently, the output voltage of op amp OP1, that is, the voltage of the gate terminal of transistor Q1 becomes larger. When the voltage of the gate terminal of transistor Q1 becomes larger, the resistance of transistor Q1 becomes smaller, and current I1 becomes bigger.

The bigger current I1 is, the bigger the voltage drops in resistors Rd0 and Rd1 become, and the smaller the difference between reference voltage Vref and voltage V− becomes. Consequently, the output voltage of op amp OP1, that is, the voltage of the gate terminal of transistor Q1 becomes smaller. When the voltage of the gate terminal of transistor Q1 becomes smaller, the resistance of transistor Q1 becomes bigger, and current I1 becomes smaller.

In other words, in range Z2, current adjuster circuit 10A adjusts the gate voltage of transistor Q1 so that voltage V− becomes equal to reference voltage Vref. Stated differently, current adjuster circuit 10A adjusts the gate voltage of transistor Q1 so that current I1 flowing through first light-emitting element column LEDG1 becomes the value shown in Equation 1 below.

$$I1=(Vref-R0\times I0)/R1 \quad \text{(Equation 1)}$$

(3) Range Z3

Range Z3 is a range in which current is supplied from the bypass circuit (i.e., the range in which the predetermined condition is satisfied), out of the range in which the magnitude of constant current I0 is greater than the first threshold value and less than a second threshold value (i.e., range Z2+range Z3). In range Z3, both first light-emitting element column LEDG1 and second light-emitting element column LEDG2 are turned ON.

In range Z3, the following relationships are satisfied: $(R0+R1)\times I0<Vref<R0\times I0$; and $R1\times(I1+Ib)\leq R2\times(I2-Ib)+Vd$. In range Z3, current adjuster circuit 10A adjusts the magnitude of the current flowing through first light-emitting element column LEDG1 so that current I1 becomes smaller and current I2 becomes bigger as constant current I0 becomes bigger. It should be noted that, in the graph, the slopes of current I1 and current I2 are different between ranges Z2 and Z3.

The operation of op amp OP1 in range Z3 is basically the same as the operation in range Z2. In range Z3, current adjuster circuit 10A adjusts the gate voltage of transistor Q1 so that current I1 flowing through first light-emitting element column LEDG1 becomes the value shown in Equation 2 below.

$$I1=(Vref-R0\times I0)/R1-Ib \quad \text{(Equation 2)}$$

(4) Range Z4

Range Z4 is a range in which the magnitude of constant current I0 is greater than or equal to the first threshold value. In range Z4, first light-emitting element column LEDG1 is turned OFF and second light-emitting element column LEDG2 is turned ON.

At this time, since the relationship $Vref\leq R0\times I0$ is satisfied, the second threshold value is represented by Vref/R0. In range Z4, current adjuster circuit 10A sets the magnitude of current I1 flowing through first light-emitting element column LEDG1 to 0.

In range Z4, the voltage drop in resistor Rd0, which is the constant current detector circuit, becomes greater than reference voltage Vref. At this time, in op amp OP1, the voltage (reference voltage Vref) of the plus-side input terminal becomes less than voltage V− of the minus-side input terminal, and thus the output voltage of op amp OP1 is fixed to the L-level. As such, transistor Q1 is turned OFF, and current I1 of first light-emitting element column LEDG1 becomes 0.

3. Advantageous Effects, Etc.

Illumination system 1A in this embodiment includes: a first detector circuit that detects the magnitude of current I1 flowing through first light-emitting element column LEDG1; a second detector circuit that detects the magnitude of current I2 flowing through second light-emitting element column LEDG2; a bypass circuit that passes part of current I2 to the first detector circuit; and current adjuster circuit 10A that adjusts the magnitude of the current flowing through first light-emitting element column LEDG1, according to the magnitude of the current detected by the first detector circuit.

With this, it is possible to create a state in which first light-emitting element column LEDG1 is turned OFF and second light-emitting element column LEDG2 is turned ON, and thus it is possible to broaden the color toning range.

In addition, in illumination system 1A, the sum of the forward voltages of second light-emitting element column LEDG2 is greater than the sum of the forward voltages of first light-emitting element column LEDG1, and thus it is possible to create a state in which first light-emitting element column LEDG1 is turned ON and second light-emitting element column LEDG2 is turned OFF. This allows the color toning range to be further broadened.

Stated differently, when the magnitude of constant current I0 is less than or equal to the first threshold value, current adjuster circuit 10A adjusts the magnitude of current I1 flowing through first light-emitting element column LEDG1 so that current I2 flowing through second light-emitting element column LEDG2 becomes 0. In addition, when the magnitude of constant current I0 is greater than or equal to the second threshold value, current adjuster circuit 10A adjusts the magnitude of current I1 flowing through first light-emitting element column LEDG1 to 0.

With this, it is possible to provide range Z1 in which only first light-emitting element column LEDG1 is turned ON, range Z2 in which both first light-emitting element column LEDG1 and second light-emitting element column LEDG2 are turned ON, and range Z4 in which only second light-emitting element column LEDG2 is turned ON. In other words, it is possible to create the states in range Z1 and range Z4 which do not exist in the comparative example, and thus the color toning range can be broadened further than in the comparative example.

Furthermore, in this embodiment, the color distribution characteristics of first light-emitting element column LEDG1 and the color distribution characteristics of second light-emitting element column LEDG2 are different. By adopting the arrangement illustrated in FIG. 5, first light-emitting element column LEDG1 can be used as indirect illumination, and second light-emitting element column LEDG2 can be used as direct illumination. More specifically, in illumination system 1A, in the case of low illumination intensity, first light-emitting element column LEDG1 can be turned ON to implement indirect illumination with light that is of a color approximating the warm color of first light-emitting element column LEDG1. Furthermore, in the case of high illumination intensity, second light-emitting element column LEDG2 can be turned ON to implement direct illumination with light that is of a color approximating the cool color of second light-emitting element column LEDG2. This allows the dramatic effect of the illumination system to be further enhanced.

In addition, by having the bypass circuit, illumination system 1A in this embodiment is capable of changing the amount of change in illumination intensity, in the range where both first light-emitting element column LEDG1 and second light-emitting element column LEDG2 are turned ON, as illustrated in FIG. 6. With this, more pleasant color toning can be implemented.

Figure 7A:
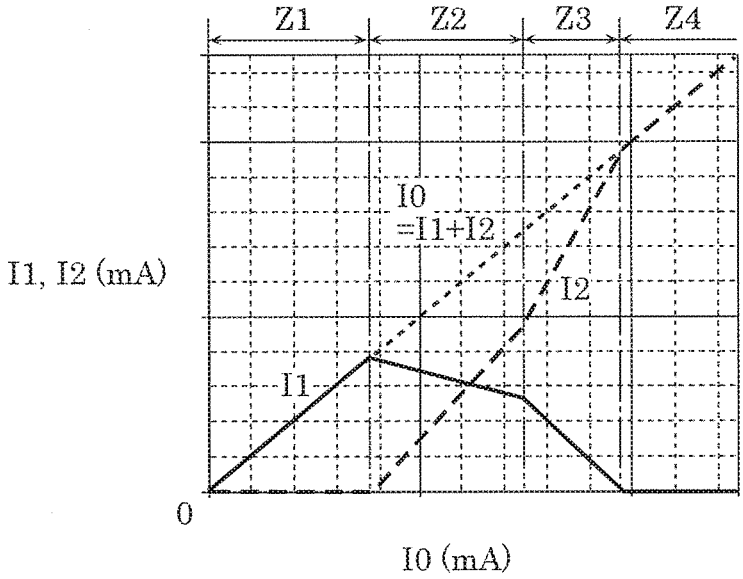
FIG. 7A is a graph illustrating another example of a dimming pattern in the embodiment.
Figure 7B:
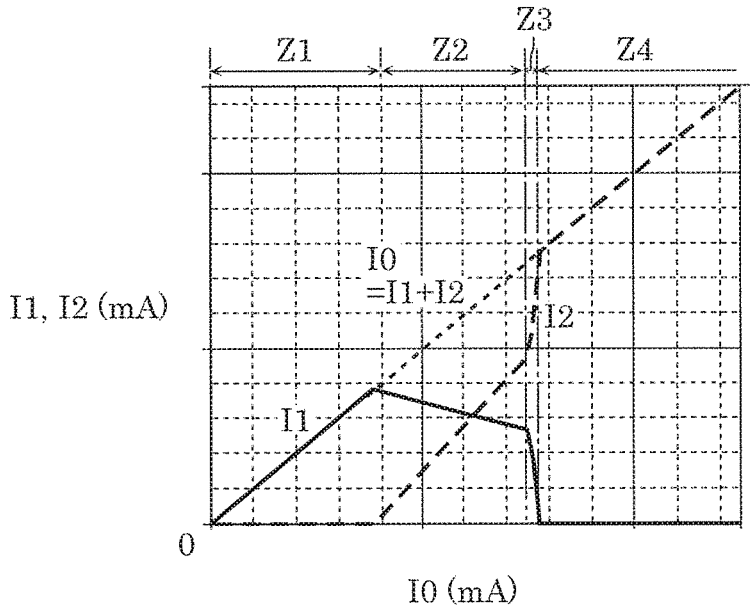
FIG. 7B is a graph illustrating another example of a dimming pattern in the embodiment.

FIG. 7A and FIG. 7B are graphs illustrating other examples of dimming patterns of respective light-emitting element columns for implementing a predetermined color toning curve (hereinafter referred to as dimming pattern(s)), in this embodiment. Compared to FIG. 6, FIG. 7A and FIG. 7B illustrate examples of cases in which the resistance of the resistors (Rd0 to Rd2) have been changed. In this manner, by setting the resistances of the resistors, dimming that is in accordance with the type of the luminaire can be obtained.

4. Variations

Figure 8:
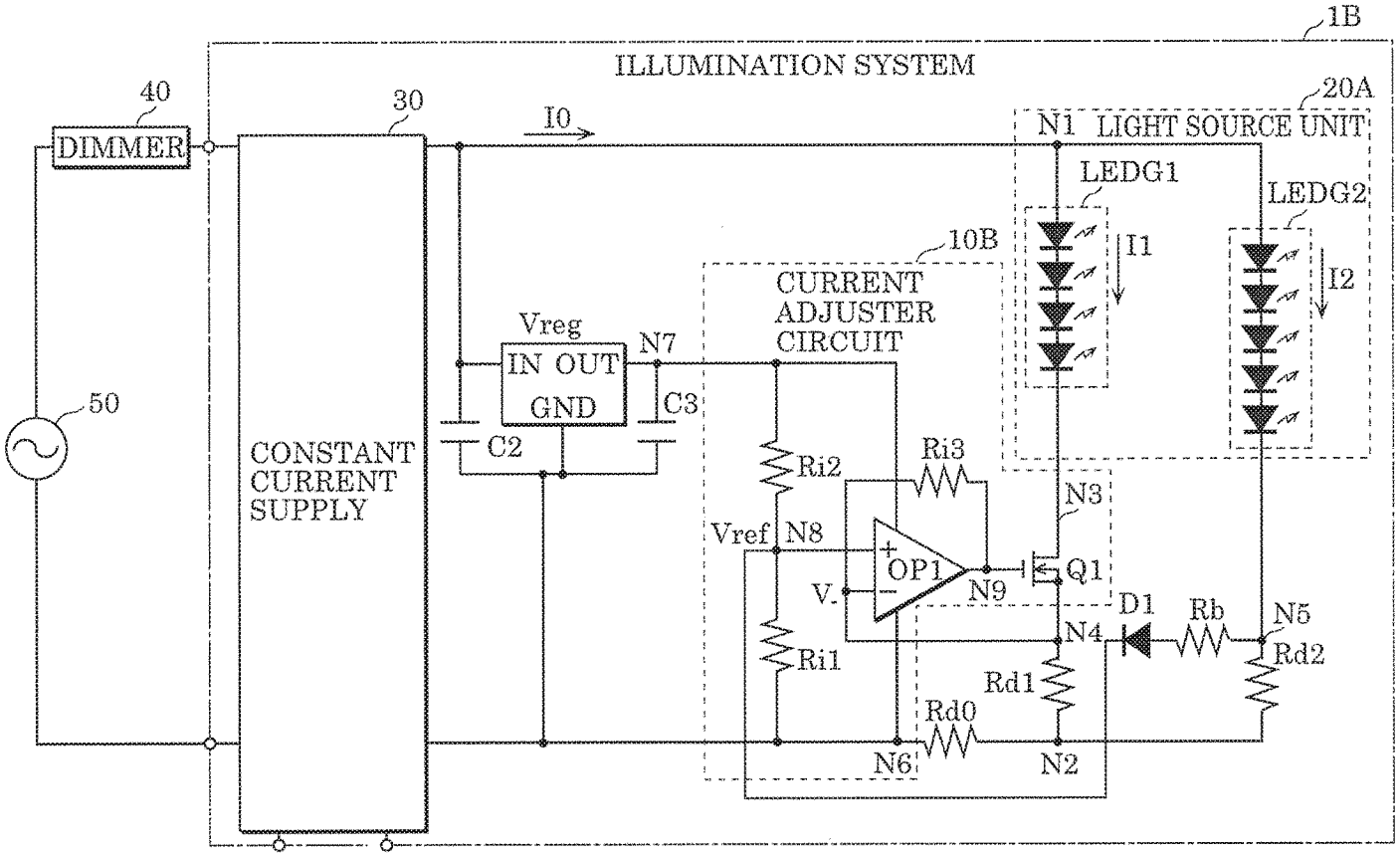
FIG. 8 is a circuit diagram illustrating an example of the circuit configuration of an illumination system in Variation 1 of the embodiment.

FIG. 8 is a circuit diagram illustrating an example of the circuit configuration of an illumination system in Variation 1 of the embodiment. Whereas the cathode terminal of diode D1 of the bypass circuit is connected to node N4 in illumination system 1A in the foregoing embodiment illustrated in FIG. 4, the cathode terminal of diode D1 of the bypass circuit is connected to the plus-side input terminal of op amp OP1 in illumination system 1B in this variation. In other words, in this variation, the bypass circuit passes, to current adjuster circuit 10B, at least part of the current flowing through second light-emitting element column LEDG2, when, as the predetermined condition, the voltage of node N5 is greater than the voltage of node N8.

Stated differently, the bypass circuit passes, to current adjuster circuit 10B, at least part of the current flowing through second light-emitting element column LEDG2, when, as the predetermined condition, the voltage at the one end (node N5) of the bypass circuit which is connected to second light-emitting element column LEDG2 is greater than predetermined reference voltage Vref at the other end (node N8) of the bypass circuit.

In this case, the current flowing through the bypass circuit flows to resistor Ri1. Since the resistance of resistor Ri1 is greater than the resistance of resistor Rd1, this variation allows the current flowing through the bypass circuit to be reduced further than in illumination system 1A in the foregoing embodiment. As such, power loss can be suppressed.

Figure 9:
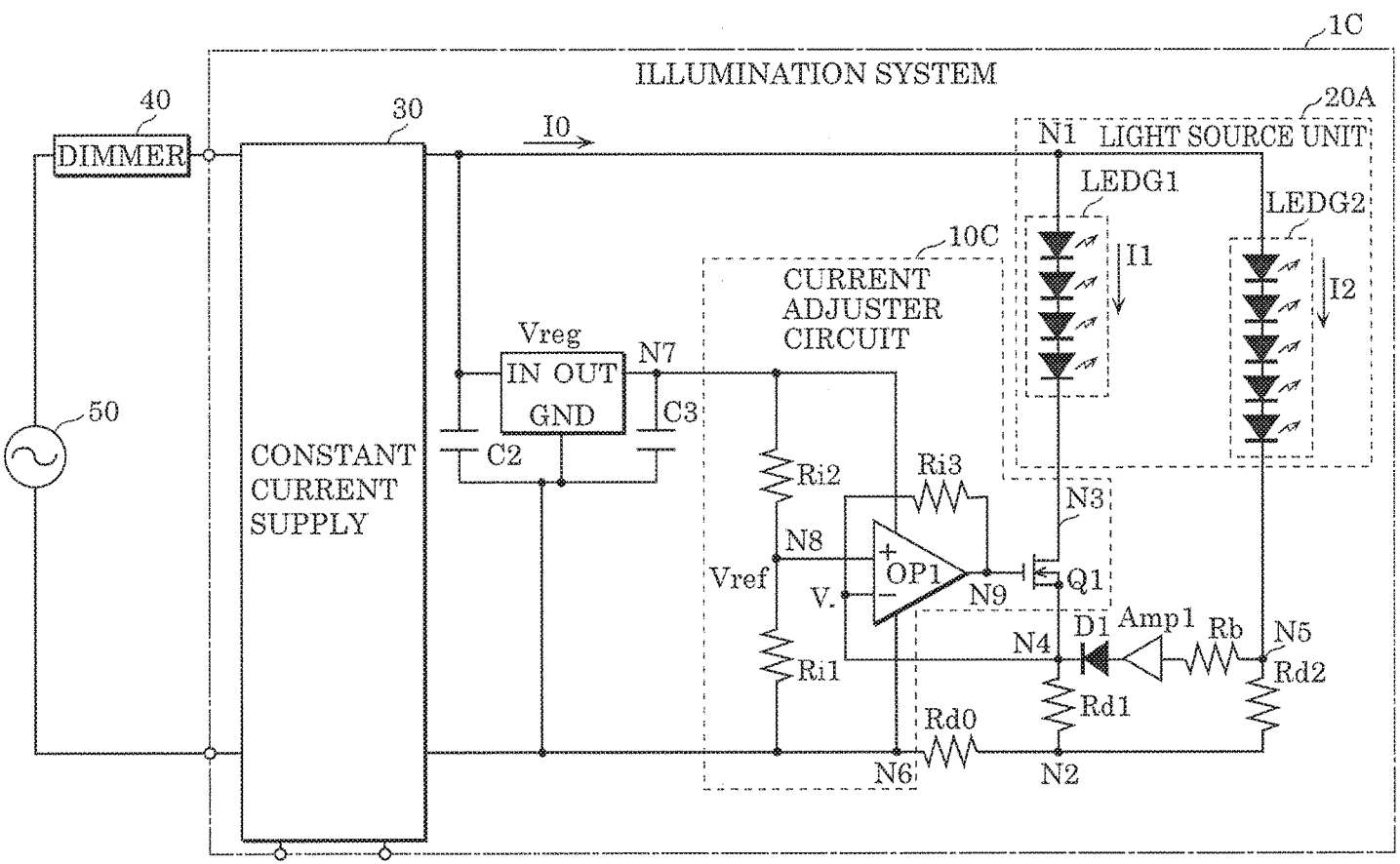
FIG. 9 is a circuit diagram illustrating an example of the circuit configuration of an illumination system in Variation 2 of the embodiment.

FIG. 9 is a circuit diagram illustrating an example of the circuit configuration of an illumination system in Variation 2 of the embodiment. Current adjuster circuit 10C included in illumination system 1C in this variation has a configuration in which amplifier circuit Amp1 is added to the bypass circuit of current adjuster circuit 10A in the foregoing embodiment. Amplifier circuit Amp1 is connected between diode D1 and resistor Rb. Stated differently, amplifier circuit Amp1 has an output terminal connected to the anode terminal of diode D1, and an input terminal connected to the one end of resistor Rb.

Accordingly, even if little of the current flowing through second light-emitting element column LEDG2 is passed to current adjuster circuit 10C, amplification by amplifier circuit Amp1 allows the advantageous effects of the bypass circuit to be produced. In other words, it is possible to reduce the resistance of resistor Rd2, and reduce the current passed to current adjuster circuit 10C. Therefore, power loss in resistor Rd2 can be reduced.

Figure 10:
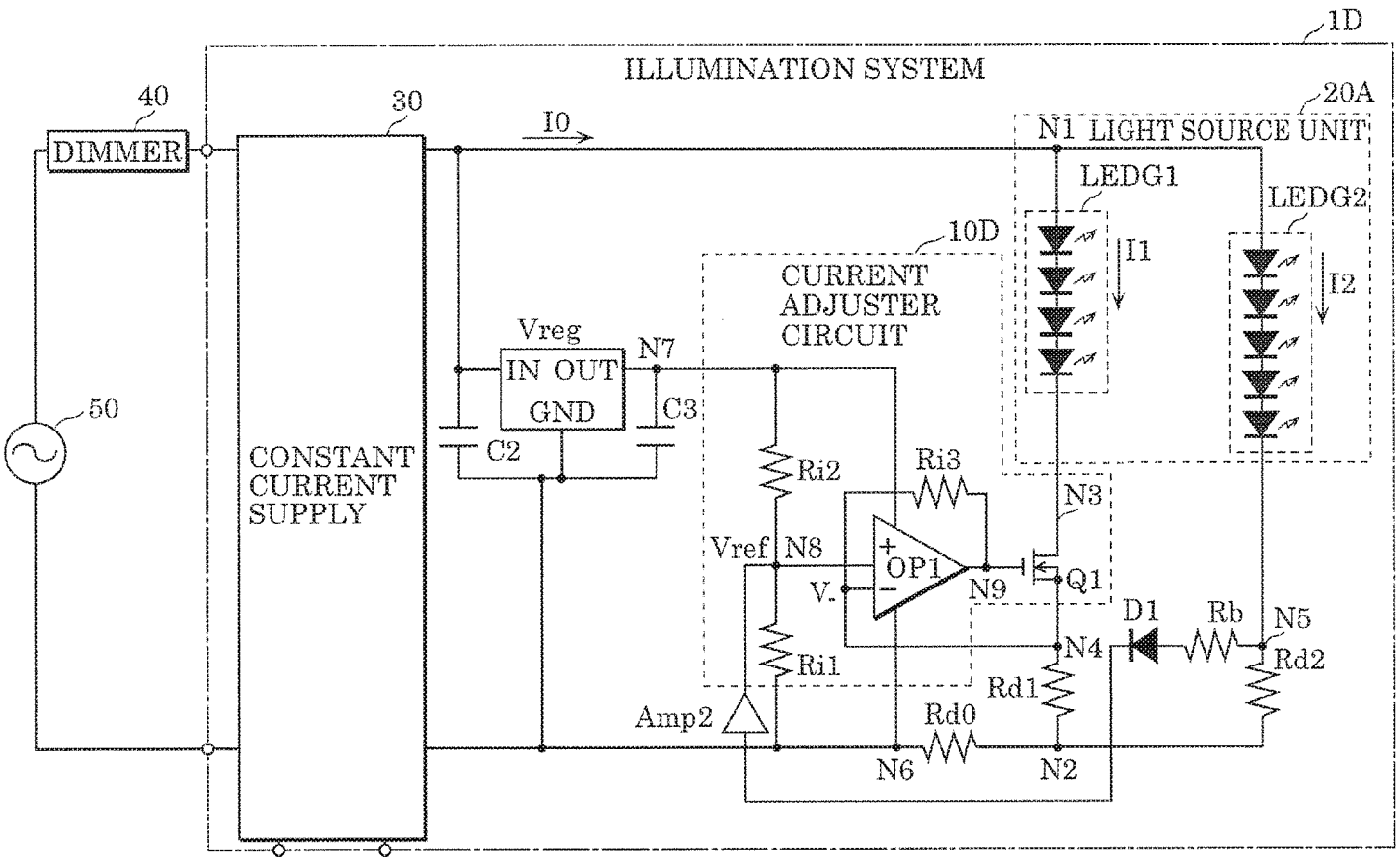
FIG. 10 is a circuit diagram illustrating an example of the circuit configuration of an illumination system in Variation 3 of the embodiment.

FIG. 10 is a circuit diagram illustrating an example of the circuit configuration of an illumination system in Variation 3 of the embodiment. Current adjuster circuit 10D included in illumination system 1D in this variation has a configuration in which amplifier circuit Amp2 is added to current adjuster circuit 10B in Variation 1.

Amplifier circuit Amp2 is connected between diode D1 and node N8 (i.e., the node to which the plus-side input terminal of op amp OP1 is connected). Stated differently, amplifier circuit Amp2 has an output terminal connected to node N8, and an input terminal connected to the cathode terminal of diode D1. In other words, as in Variation 1, in this variation, the bypass circuit also passes, to current adjuster circuit 10D, at least part of the current flowing through second light-emitting element column LEDG2, when, as the predetermined condition, the voltage of node N5 is greater than the voltage of node N8.

In this case, the current flowing through the bypass circuit flows to resistor Ri1. Since the resistance of resistor Ri1 is greater than the resistance of resistor Rd1, this variation allows the current flowing through the bypass circuit to be reduced further than in illumination system 1A in the foregoing embodiment. As such, power loss can also be suppressed in this variation, as in Variation 1.

Furthermore, as in Variation 2, in this variation, even if little of the current flowing through second light-emitting element column LEDG2 is passed to current adjuster circuit 10D, amplification by amplifier circuit Amp2 allows the advantageous effects of the bypass circuit to be produced. In other words, it is possible to reduce the resistance of resistor Rd2, and reduce the current passed to current adjuster circuit 10D. Therefore, power loss in resistor Rd2 can be reduced.

Variations 1 to 3 also produce the same advantageous effects as in the foregoing embodiment.

[Others]

Although illumination systems and luminaires according to the present disclosure are described thus far based on the foregoing embodiment and variations thereof, the present disclosure is not limited to the foregoing embodiment and variations.

(1) For example, although the case where the first light-emitting elements and the second light-emitting elements are LEDs is exemplified in the foregoing embodiment and Variations 1 to 3, the present disclosure is not limited to such a configuration. The first light-emitting elements and the second light-emitting elements may be configured of other light-emitting elements such as organic electroluminescence (EL) elements, etc.

(2) Although the foregoing embodiment and Variations 1 to 3 exemplify the case where the magnitude of the forward voltages is the same (the same type) for all the LEDs which are examples of the first light-emitting elements and the second light-emitting elements, the present disclosure is not limited to such a configuration. It is preferable that the following relationship be satisfied: the sum of the forward voltages of the first light-emitting element column<the sum of the forward voltages of the light-emitting element column in the last stage.

(3) Although the foregoing embodiment describes the case where the illumination system includes plural light-emitting element columns between which both color temperature and light distribution characteristics are different, the present disclosure is not limited to such a configuration. The illumination system may be of another configuration such as one which includes plural light-emitting element columns between which, for example, only the color temperature or only the light distribution characteristics is different.

(4) Although the number of LEDs included in first light-emitting element column LEDG1 is set to 4, and the number of LEDs included in second light-emitting element column LEDG2 is set to 5 in the foregoing embodiment and Variations 1 to 3, the present disclosure is not limited to such a configuration. It is acceptable for first light-emitting element column LEDG1 to include a single first light-emitting element or a plurality of first light-emitting elements connected in series. Furthermore, it is acceptable for second light-emitting element column LEDG2 to include a single first light-emitting element or a plurality of first light-emitting elements connected in series.

It should be noted that, in the foregoing embodiment and Variations 1 to 3, due to the difference in the sums of the forward voltages, the timing for starting light-emission for second light-emitting element column LEDG2 is staggered with respect to first light-emitting element column LEDG1, and thus it is preferable that the number of LEDs in second light-emitting element column LEDG2 be greater than the number of LEDs in first light-emitting element column LEDG1.

(5) Although a constant current detector circuit is provided in the foregoing embodiment and Variations 1 to 3, the constant current detector circuit is not an essential structural component.

(6) In the foregoing embodiment and Variations 1 to 3, a light-emitting element column may further be provided in the wiring line through which constant current I0 flows.

Figure 11:
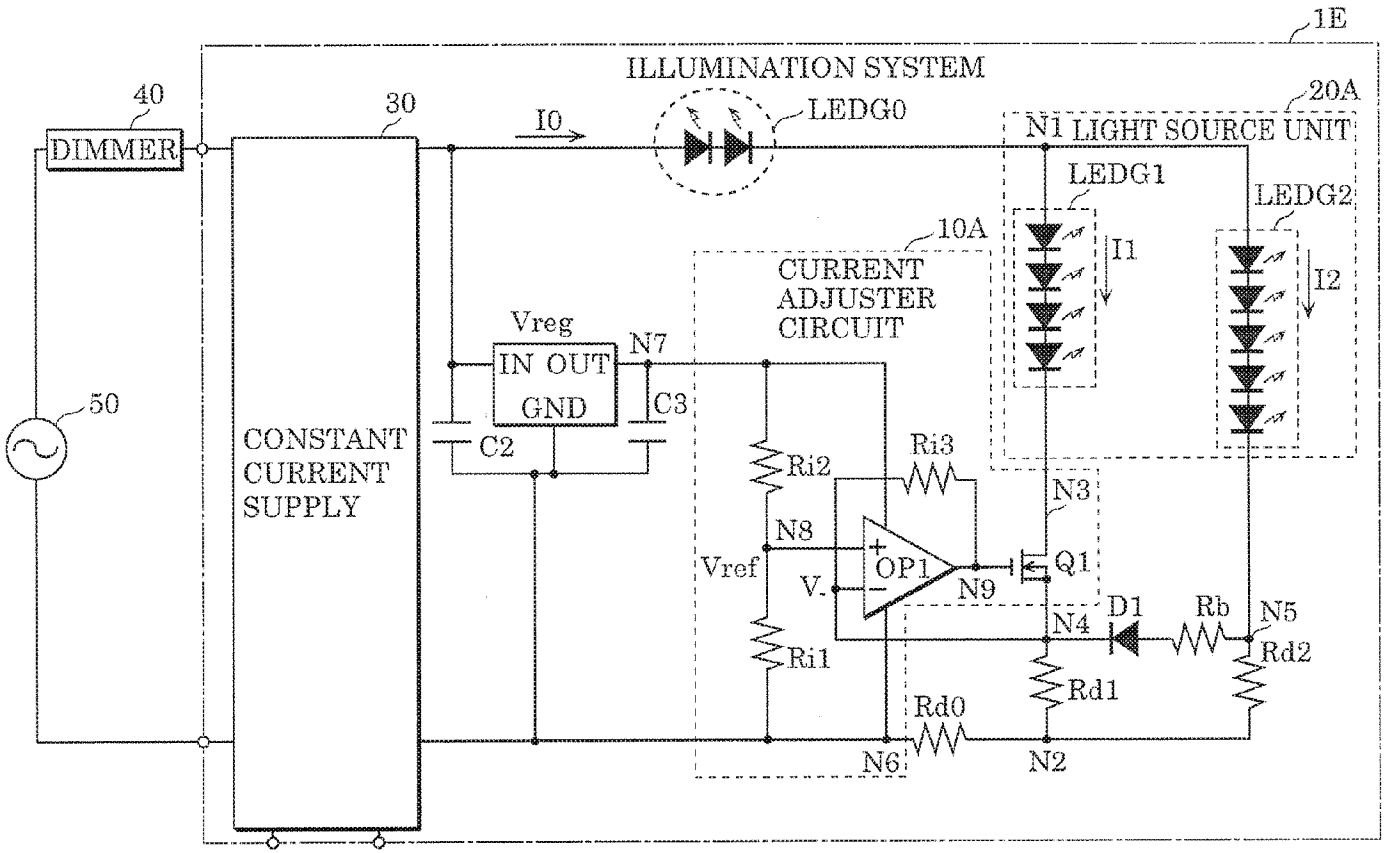
FIG. 11 is a circuit diagram illustrating an example of the circuit configuration of an illumination system in Variation 4 of the embodiment.

FIG. 11 is a circuit diagram illustrating an example of the circuit configuration of an illumination system in the case (Variation 4 of the embodiment) where a light-emitting element column is provided in the wiring line through which constant current I0 flows. Illumination system 1E illustrated in FIG. 11 includes constant current supply 30, light source unit 20A, three-terminal regulator Vreg, the first detector circuit, the constant current detector circuit, current adjuster circuit 10A, and light-emitting element column LEDG0. Other than including light-emitting element column LEDG0, everything is the same as in the foregoing embodiment. Accordingly, dimming control and light-distribution control flexibility can be improved.

(7) Although the case where the light-emitting element columns consist of two columns is exemplified in the foregoing embodiment and Variations 1 to 3, three or more light-emitting element columns may be included. In such a case, it is sufficient that a current adjuster circuit be provided to one or more of the light-emitting element columns. Stated differently, it is acceptable to have a configuration in which a current adjuster circuit is not provided to one or more of the light-emitting element columns.

(8) Although the case where the luminaire is a downlight is exemplified in the foregoing embodiment and Variations 1 to 3, the luminaire in the present disclosure can be applied to an arbitrary appliance such as a projector or an indoor light.

(9) Forms obtained by various modifications to the exemplary embodiment that can be conceived by a person of skill in the art as well as forms realized by arbitrarily combining structural components and functions in the exemplary embodiment which are within the scope of the essence of the present disclosure are included in the present disclosure.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. An illumination system comprising:

a first light-emitting element column including one of a single first light-emitting element or a plurality of first light-emitting elements connected in series;

a second light-emitting element column connected in parallel with the first light-emitting element column, and including one of a single second light-emitting element or a plurality of second light-emitting elements connected in series;

a constant current supply that supplies a constant current to a light source unit that includes the first light-emitting element column and the second light-emitting element column;

a first detector circuit that is connected in series with the first light-emitting element column, and detects a magnitude of current flowing through at least the first light-emitting element column;

a current adjuster circuit that adjusts the magnitude of the current flowing through the first light-emitting element column, according to the magnitude of the current detected by the first detector circuit; and a bypass circuit that passes, to one of the first detector circuit or the current adjuster circuit, at least part of current flowing through the second light-emitting element column, when a predetermined condition is satisfied.

2. The illumination system according to claim 1, wherein a sum of forward voltages of the one of the single second light-emitting element or the plurality of second light-emitting elements included in the second light-emitting element column is greater than a sum of forward voltages of the one of the single first light-emitting element or the plurality of first light-emitting elements included in the first light-emitting element column.

3. The illumination system according to claim 1, wherein the current adjuster circuit changes the magnitude of the current flowing through the first light-emitting element column to set a magnitude of the current flowing through the second light-emitting element column to zero, when a magnitude of the constant current is less than or equal to a first threshold value.

4. The illumination system according to claim 3, wherein the current adjuster circuit sets the magnitude of the current flowing through the first light-emitting element column to zero, when the magnitude of the constant current is greater than or equal to a second threshold value which is greater than the first threshold value.

5. The illumination system according to claim 1, wherein the bypass circuit passes, to the first detector circuit, the at least part of the current flowing through the second light-emitting element column, the illumination system further comprises a second detector circuit that is connected in series with the second light-emitting element column, and detects a magnitude of at least another part of the current flowing through the second light-emitting element column, and the current adjuster circuit changes the magnitude of the current flowing through the first light-emitting element column, according to the magnitude of the current detected by the second detector circuit, in addition to the magnitude of the current detected by the first detector circuit.

6. The illumination system according to claim 5, wherein the current adjuster circuit compares the magnitude of the current detected by the first detector circuit with a reference value, and changes the magnitude of the current flowing through the first light-emitting element column according to a result of the comparison.

7. The illumination system according to claim 6, wherein the bypass circuit changes the reference value according to a result of detection by the second detector circuit, by passing, to the current adjuster circuit, the at least part of the current flowing through the second light-emitting element column.

8. The illumination system according to claim 1, wherein a color temperature of the one of the single first light-emitting element or the plurality of first light-emitting elements is lower than a color temperature of the one of the single second light-emitting element or the plurality of second light-emitting elements.

9. The illumination system according to claim 1, wherein light distribution characteristics of the first light-emitting element column and light distribution characteristics of the second light-emitting element column are different.

10. The illumination system according to claim 1, wherein the bypass circuit passes, to one of the first detector circuit or the current adjuster circuit, the at least part of the current flowing through the second light-emitting element column, when, as the predetermined condition, a voltage drop in the second light-emitting element column is smaller than a voltage drop in the first light-emitting element column.

11. The illumination system according to claim 1, wherein the bypass circuit passes, to the current adjuster circuit, the at least part of the current flowing through the second light-emitting element column, when, as the predetermined condition, a voltage at one end of the bypass circuit which is connected to the second light-emitting element column is higher than a predetermined reference voltage at an other end of the bypass circuit.

12. A luminaire comprising:

the illumination system according to claim 1; and a dimmer that adjusts a magnitude of the constant current of the constant current supply.

* * * * *